United States Patent [19]

Ohtsuka et al.

[11] Patent Number: 4,727,393

[45] Date of Patent: Feb. 23, 1988

[54] PROCESSING HEAD FOR ELECTROPHOTOGRAPHIC APPARATUS

[75] Inventors: Shuichi Ohtsuka; Akira Yoda; Akinori Kimura, all of Kanagawa, Japan

[73] Assignee: Fuji Photo Film Co., Ltd., Kanagawa, Japan

[21] Appl. No.: 920,336

[22] Filed: Oct. 17, 1986

[30] Foreign Application Priority Data

Oct. 18, 1985 [JP] Japan ..... 60-233061

[51] Int. Cl.[4] ..... G03G 15/00

[52] U.S. Cl. ..... 355/312; 355/10; 355/16

[58] Field of Search ..... 355/312, 10, 16, 27; 354/300, 317

[56] References Cited

U.S. PATENT DOCUMENTS

| | | | |
|---|---|---|---|
| 3,528,355 | 9/1970 | Blackert | 355/10 |
| 3,697,173 | 10/1972 | Sasaki et al. | 355/10 X |
| 3,964,828 | 6/1976 | Yamada et al. | 355/10 |
| 3,972,610 | 8/1976 | Gross | 355/10 |
| 4,461,561 | 7/1984 | Plumadore | 355/16 X |
| 4,600,291 | 7/1986 | Ohtsuka et al. | 355/10 X |
| 4,623,240 | 11/1986 | Kimura et al. | 355/10 |

*Primary Examiner*—Patrick R. Salce
*Assistant Examiner*—Kristine Peckman
*Attorney, Agent, or Firm*—Sughrue, Mion, Zinn, Macpeak and Seas

[57] ABSTRACT

A processing head for an electrophotographic apparatus has a developing section for developing an electrophotographic film with a liquid developer, and a drying section disposed adjacent to and on the downstream side of the developing section in the direction in which the film is advanced, to dry the film wetted with the developer by passing a gas in a direction that intersects the film advancing direction. The drying section is provided with a pair of frame members extending in a direction that intersects the film advancing direction so as to define both ends of the drying section in the film advancing direction. In addition, a pair of recesses are formed along opposing walls of the frame members, respectively. Accordingly, the flow rate of the gas passed through the recesses is higher than that of the gas passed along the other portion between the frame members.

22 Claims, 19 Drawing Figures

(A)

(B)

200
202A
202
204A
204
206
198

232
228
226B
230
234A
A
234
226
224
222
C
B
214B
216
214
E
D
200
198
212
212A
214A
218
220
226A
60

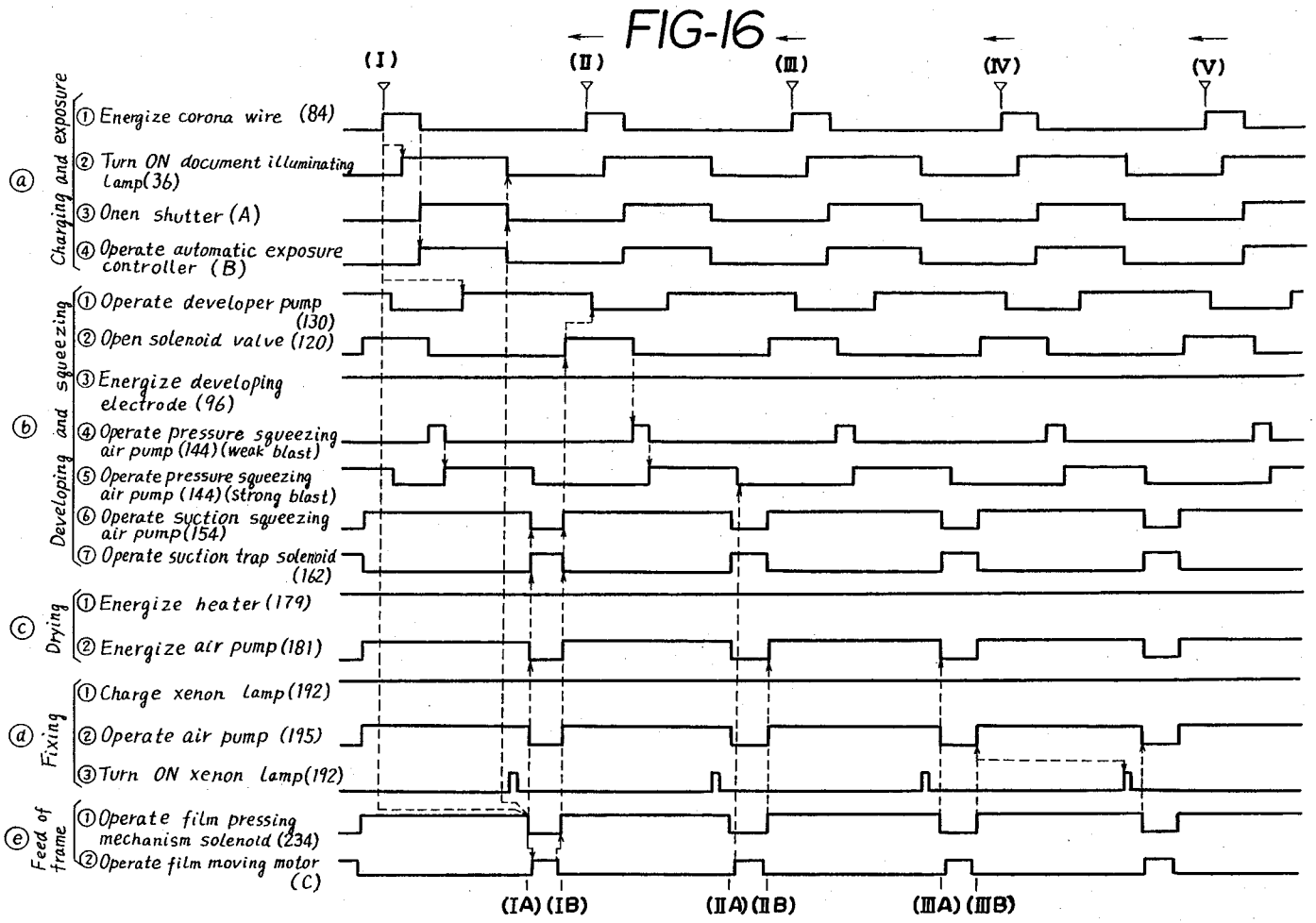
FIG-16
(I)
(II)
(III)
(IV)
(V)
(IA) (IB)
(IIA) (IIB)
(IIIA) (IIIB)
ⓐ Charging and exposure
① Energize corona wire (84)
② Turn ON document illuminating lamp(36)
③ Open shutter (A)
④ Operate automatic exposure controller (B)
ⓑ Developing and squeezing
① Operate developer pump (130)
② Open solenoid valve (120)
③ Energize developing electrode (96)
④ Operate pressure squeezing air pump (144) (weak blast)
⑤ Operate pressure squeezing air pump (144) (strong blast)
⑥ Operate suction squeezing air pump(154)
⑦ Operate suction trap solenoid (162)
ⓒ Drying
① Energize heater (179)
② Energize air pump(181)
ⓓ Fixing
① Charge xenon lamp(192)
② Operate air pump (195)
③ Turn ON xenon lamp(192)
ⓔ Feed of frame
① Operate film pressing mechanism solenoid (234)
② Operate film moving motor (C)

PROCESSING HEAD FOR ELECTROPHOTOGRAPHIC APPARATUS

BACKGROUND OF THE INVENTION

1. Field of the Invention

The present invention relates to a processing head employed in an electrophotographic apparatus to subject an electrophotographic film to various kinds of processing.

2. Description of the Related Art

One type of photographic apparatus has heretofore been know which is capable of recording an image on a predetermined frame of a photographic film. This type of apparatus is disclosed in, for example, U.S. Pat. Nos. 3,528,355, 3,697,173, 3,964,828, 3,972,610 and 4,461,561.

Also, a processing head is disposed in such photographic apparatus to subject an electrophotographic film to various kinds of processing such as charging/exposure, development and drying and such processing head is known from the specifications of U.S. Pat. No. 4,600,291 and U.S. patent application Ser. No. 696,590 filed Jan. 31, 1985.

The processing head disclosed in the above-described specifications has a charging exposure section, a developing section, a drying section and a fixing section, which are disposed in that order and adjacent one to another along the direction in which the electrophotographic film is advanced. The pitch at which these sections are disposed is set such as to be constant and equal to the frame pitch of the film.

In the charging exposure section, a portion of the electrophotographic film (corresponding to one frame) which is positioned at this section is first charged and then irradiated with light which is reflected from a document, and the image of the document is thereby formed on the film to effect light exposure. Thus, an electrostatic latent image corresponding to the image pattern on the document is formed on the film. In the developing section, the electrophotographic film exposed in the charging exposure section is coated with a liquid developer, and the electrostatic latent image is thereby developed. In the drying section, drying air is blown against the electrophotographic film which has been wetted with the liquid developer so as to remove hygroscopic moisture therefrom. In the fixing section, the developed image is fixed on the electrophotographic film by means, for example, of a fixing lamp.

In the developing section, after the liquid developer has been applied to the electrophotographic film, any surplus developer attached to the film is blown off. This is done because, if the surplus developer is not sufficiently removed in the developing section, when the electrophotographic film is advanced to the drying section, the remaining surplus developer may be compressed between the film and the wall surface of the drying section which faces the film and spread to adhere to an adjacent frame of the film, thus causing the image in the frame to be spoiled or damaged.

When dust or the like is attached to the developed surface of an electrophotographic film, the above-described operation of blowing the developer off the film may not be sufficiently effected, and this may give rise to the above-described problem.

SUMMARY OF THE INVENTION

In view of the above-described circumstances, it is a primary object of the present invention to provide a processing head for an electrophotographic apparatus which is so designed that, even when surplus developer is not sufficiently blown off from an electrophotographic film in the developing section, there is no adverse effect on other frames on the film.

To this end, the present invention provides a processing head for an electrophotographic apparatus, comprising: a developing section for developing an electrophotographic film with a liquid developer; a drying section disposed adjacent to and on the downstream side of the developing section in the direction in which the film is advanced, the drying section having an opposing wall opposing the film and a pair of opposing first side walls provided on both sides, respectively, of the opposing wall in such a manner as to extend in a direction which intersects the film advancing direction so that the opposing wall, the first side walls and the film define in combination a space surrounded thereby through which gas for drying is passed in a direction which intersects the film advancing direction, thereby drying the film wetted with the developer; and a recess defined between the opposing wall and the one of the first side walls which is closer to the developing section in such a manner that the recess extends in the direction in which the gas is passed.

In the processing head having the above-described arrangement, even when the surplus developer is not sufficiently blown off in the developing section, since the flow rate of the drying pumped gas passed through the recesses is larger than that of the pumped gas passed through the other portions, the surplus developer is blocked by the pumped gas at the recesses, and there is therefore no fear of the surplus developer spreading furthermore.

Since, according to the present invention, the drying chamber is disposed between the developing and fixing chambers, there is, particularly, no risk of a lamp in the fixing chamber being stained with any developer leaking out from the developing chamber. It is therefore possible to improve the reliability in the fixing process. In addition, since the drying chamber for effecting a drying processing is provided independently of the developing and fixing chambers, it is possible to arrange the drying chamber such that the distance between the surface of an electrophotographic film and the opposing wall which opposes the surface of the film is minimized. Accordingly, the drying efficiency can be increased using a relatively inexpensive air blast means, and it is possible to set a distance between the opposing wall and the film surface so that the film is dried most efficiently.

BRIEF DESCRIPTION OF THE DRAWINGS

FIG. 16 is a time chart showing various operations of the electrophotographic apparatus in the camera mode.

DESCRIPTION OF THE PREFERRED EMBODIMENT

The present invention will be described hereinunder in detail with reference to the accompanying drawings.

Figure 1:
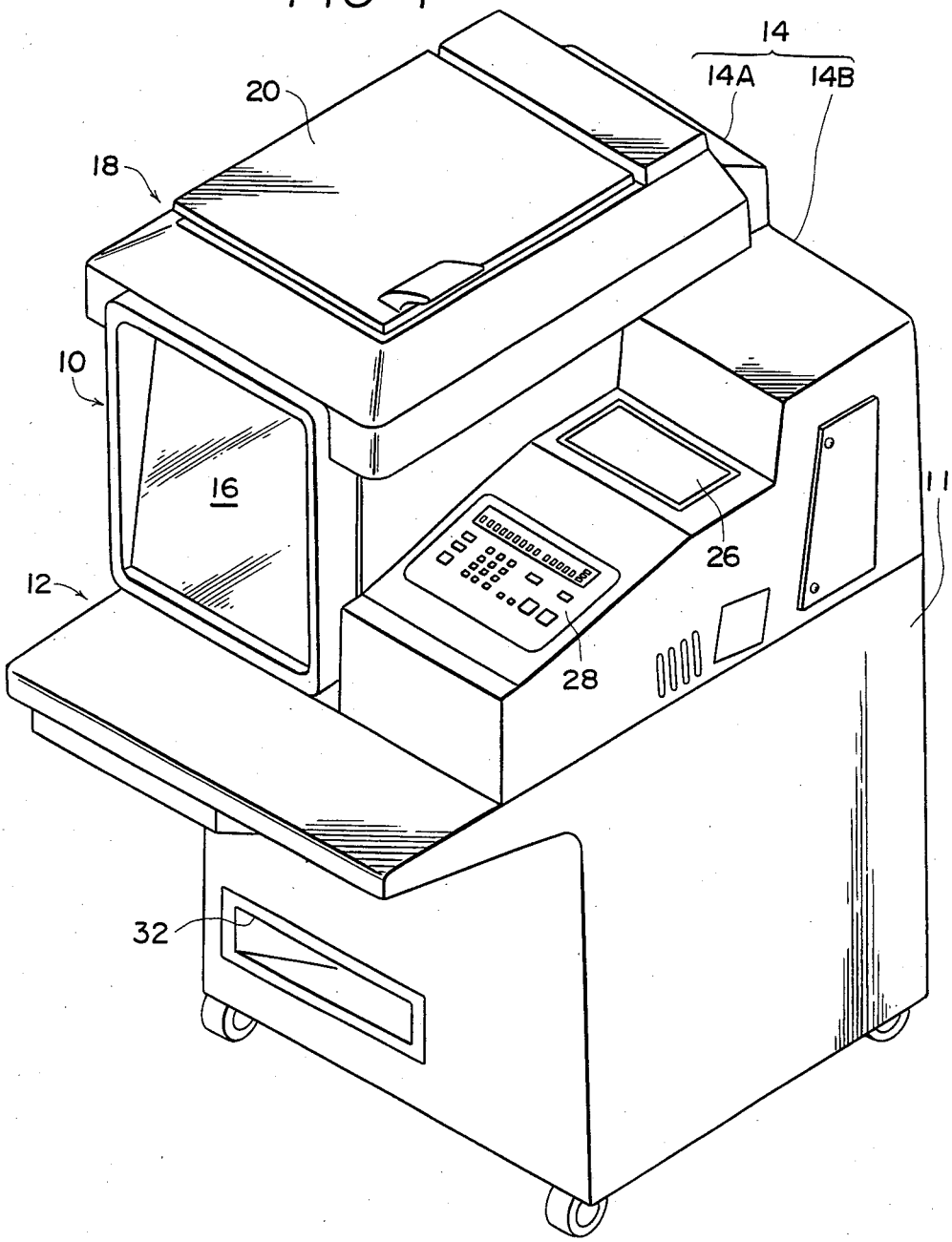
FIG. 1 is a perspective view showing the external appearance of one example of an electrophotographic apparatus.

FIG. 1 shows one example of an electrophotographic apparatus in which a processing head in accordance with one embodiment of the present invention is disposed.

This electrophotographic apparatus has various functions: namely, the camera function which enables the image of a document to be recorded on an electrophotographic film; the reader function which enables the image recorded on the film to be enlarged and projected on a screen; and the copy function which enables the image recorded on the film to be enlarged and copied on a sheet of copying paper.

The electrophotographic apparatus has an integral structure which consists of an electrophotographic apparatus body 10, a housing 11, and a copying machine 12 serving also as a table for mounting the body 10. When the copy function is not needed, the electrophotographic apparatus body 10 may be used alone. The apparatus body 10 includes a housing 14 which consists of a left-hand portion 14A having a substantially rectangular parallelepiped configuration and a right-hand portion 14B which has a stepped upper surface. The respective internal spaces of these portions 14A and 14B are communicated with each other at the side thereof which is closer to the rear end of the apparatus.

A rear projection screen 16 is disposed in the housing portion 14A in such a manner that the screen 16 closes an opening provided in the front side of the housing portion 14A and it is slightly slanted rearwardly. A document table 18 is disposed on the upper side of the housing portion 14A. The document table 18 includes a document pressing plate 20 which can be opened and closed as desired, and a transparent glass plate 22 (see FIG. 2) which is disposed underneath the plate 20 in such a manner as to close an opening provided in the upper side of the housing portion 14A. A cassette loading section 26 into which cassette accommodating an electrophotographic microfilm 24 (see FIG. 2; hereinafter referred to as an "electrophotographic film") is loaded is provided in the central portion of the upper side of the housing portion 14B. A control keyboard 28 through which various controls of the electrophotographic apparatus are effected is disposed on the front portion of the upper side of the housing portion 14B.

Figure 4:
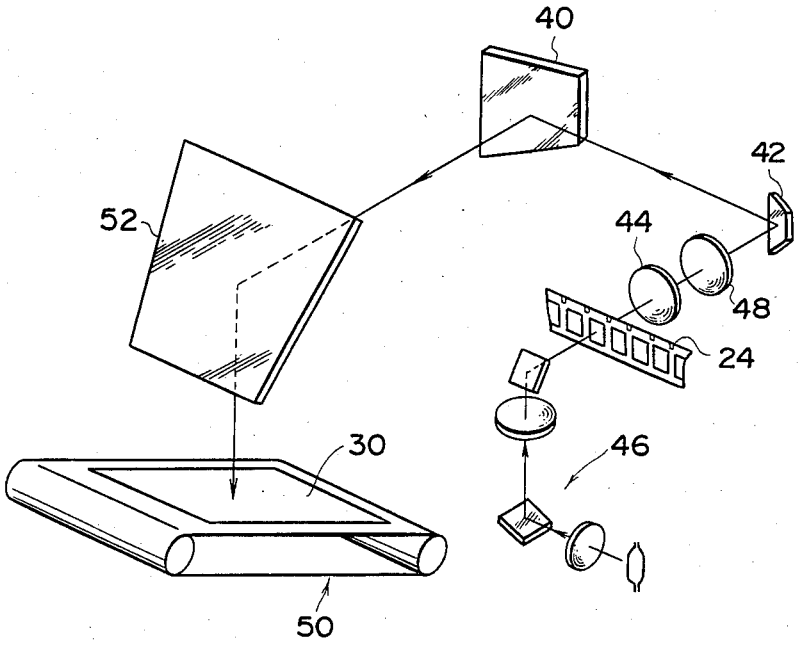
FIG. 4 is a schematic perspective view of a copying optical system in the electrophotographic apparatus.

The housing 11 of the copying machine 12 is provided with an opening 32 for delivering a copied sheet of paper 30 (see FIG. 4).

Figure 2:
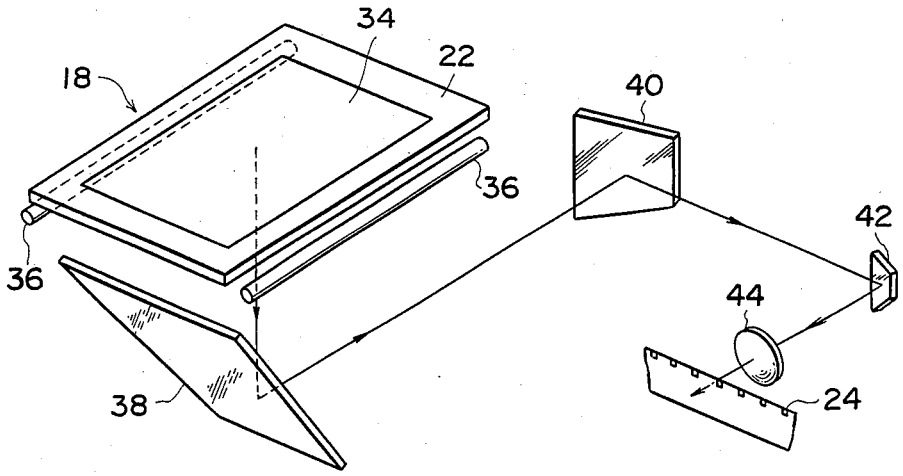
FIG. 2 is a schematic perspective view of a recording optical system in the electrophotographic apparatus.
Figure 3:
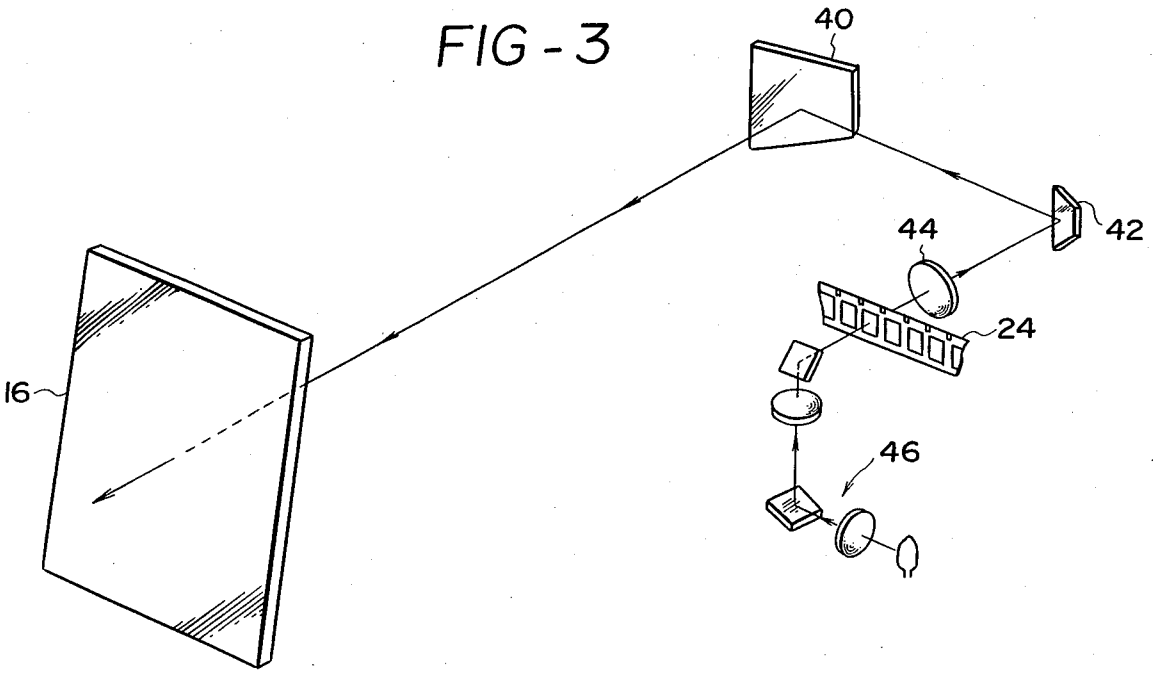
FIG. 3 is a schematic perspective view of a projecting optical system in the electrophotographic apparatus.

FIGS. 2 to 4 show various optical systems of the electrophotographic apparatus.

Referring first to FIG. 2, the recording optical system includes a document illuminating lamp 36 which illuminates a document 34 as a subject which is set on the glass plate 22 of the document table 18 in such a manner that the document surface faces downward, a third mirror 38 on which the light reflected from the document 34 is made incident, a second mirror 40 on which the light reflected from the third mirror 38 is made incident, a first mirror 42 on which the light reflected from the second mirror 40 is made incident, and a main lens 44 for focusing the light reflected from the first mirror 42 on the surface of an electrophotographic film 24.

Referring next to FIG. 3, the projecting optical system includes a projecting light source section 46 for irradiating the electrophotographic film 24, the main lens 44 for focusing the light passing through the film 24 on the first mirror 42, the second mirror 40 on which the light reflected from the first mirror 42 is made incident, and the screen 16 on which the light reflected from the second mirror 40 is projected.

As shown in FIG. 4, the copying optical system includes, the projecting light source section 46, the main lens 44, the first mirror 42, the second mirror 40, a conversion lens 48 disposed between the main lens 44 and the first mirror 42 to slightly reduce the optical image formed on the first mirror 42, and a copy mirror 52 adapted to reflect the light reflected from the second mirror 40 toward a sheet of copying paper 30 set on an exposing table 50 disposed in the copying machine 12.

The main lens 44 and the first and second mirrors 42, 40 are mutually used for the above-described three optical systems. The main lens 44 and the first mirror 42 are fixedly disposed within the housing portion 14B of the electrophotographic apparatus body 10, while the second mirror 40 is fixedly disposed within the housing portion 14A.

The third mirror 38, the copy mirror 52, the conversion lens 48 and the screen 16 are selectively used. The third mirror 38 and the copy mirror 52 are movably disposed within the housing portion 14A of the apparatus body 10, while the conversion lens 48 is movably disposed within the housing portion 14B so that the lens 48 is prevented from interferring with any other optical systems. Since the screen 16 does not interfere with any other optical systems, it is fixedly disposed as described above.

In addition, a shutter (not shown) which is controlled by an automatic exposure controller is disposed between the main lens 44 and the first mirror 42 in the optical systems of the electrophotographic apparatus.

FIGS. 5 to 13 show in combination one embodiment of the processing head according to the present invention which is disposed in the above-described electrophotographic apparatus.

Figure 5:
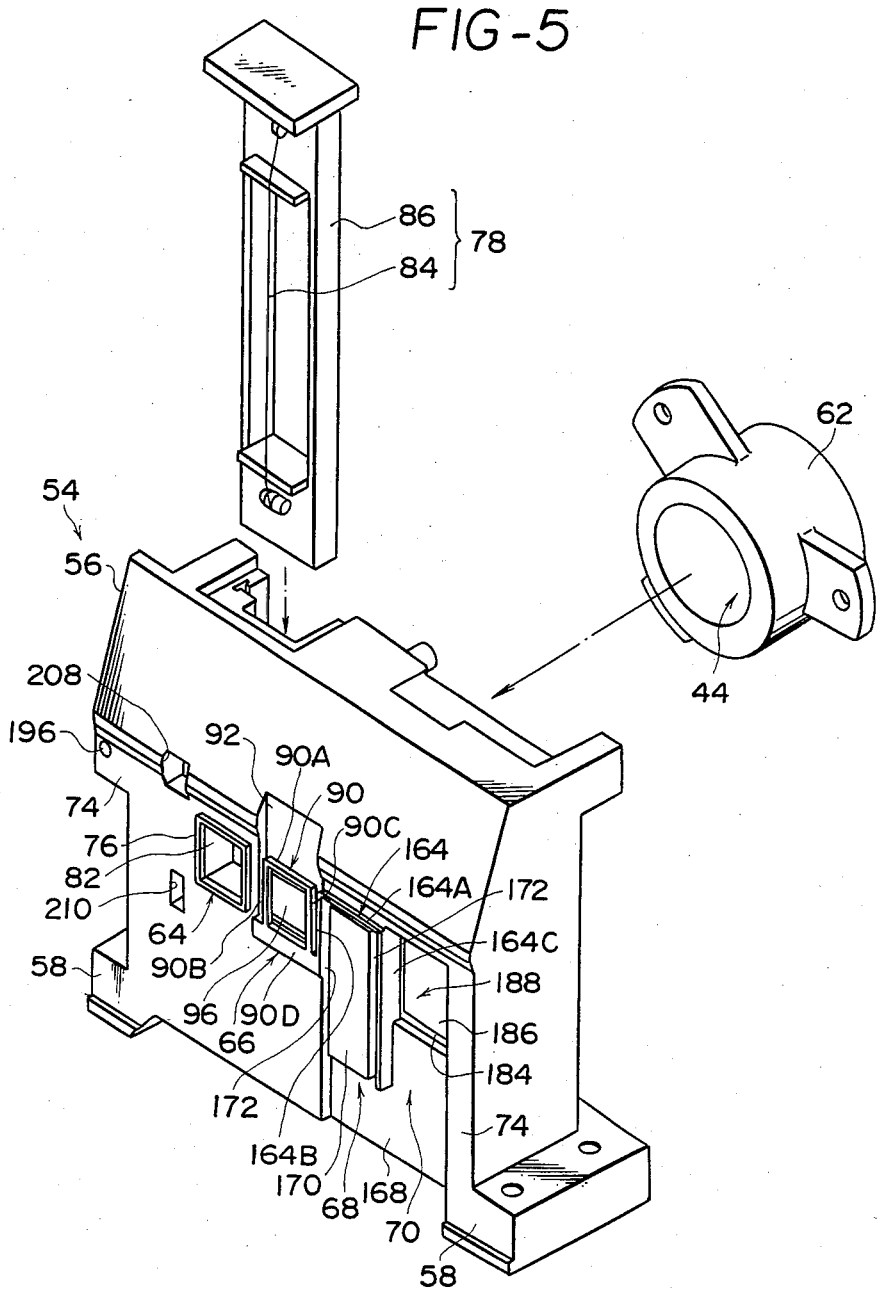
FIG. 5 is an exploded perspective view of a processing head in accordance with one embodiment of the present invention which is disposed in the electrophotographic apparatus shown in FIG. 1.
Figure 6:
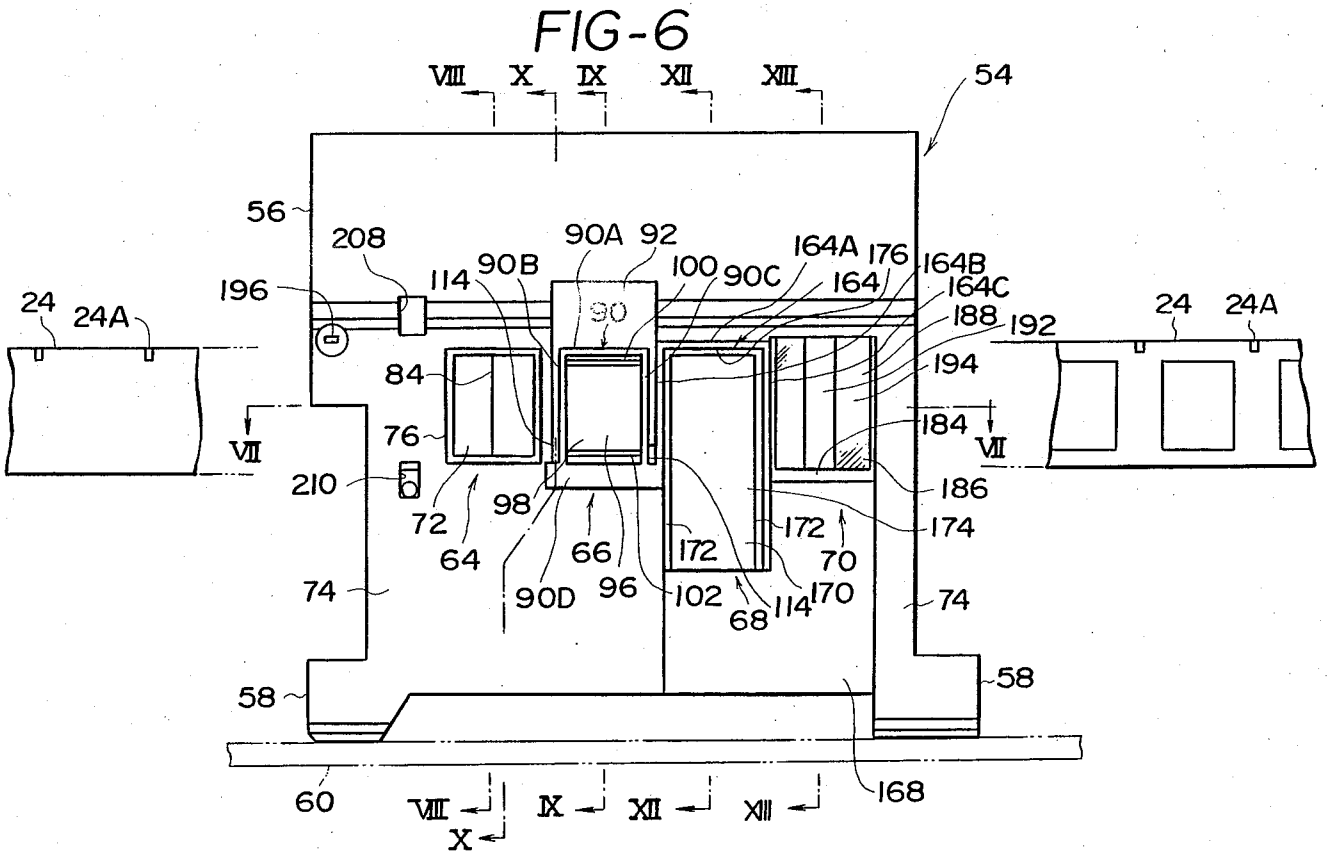
FIG. 6 is a front view of the processing head.

Referring first to FIGS. 5 and 6, the processing head 54 has an integral structure which consists of a relatively flat body portion 56 having a substantially rectangular parallelepiped configuration, and a pair of leg portions 58 located below the body portion 56. The processing head 54 is formed from a synthetic resin by an integral molding process except for fitting members. The processing head 54 is disposed betwee the main lens 44 and the electrophotographic film 24, which are shown in FIGS. 2 to 4, and the leg portions 58 are secured to a frame 60 disposed within the housing portion 14B of the apparatus body 10, as shown in FIG. 6.

Figure 7:
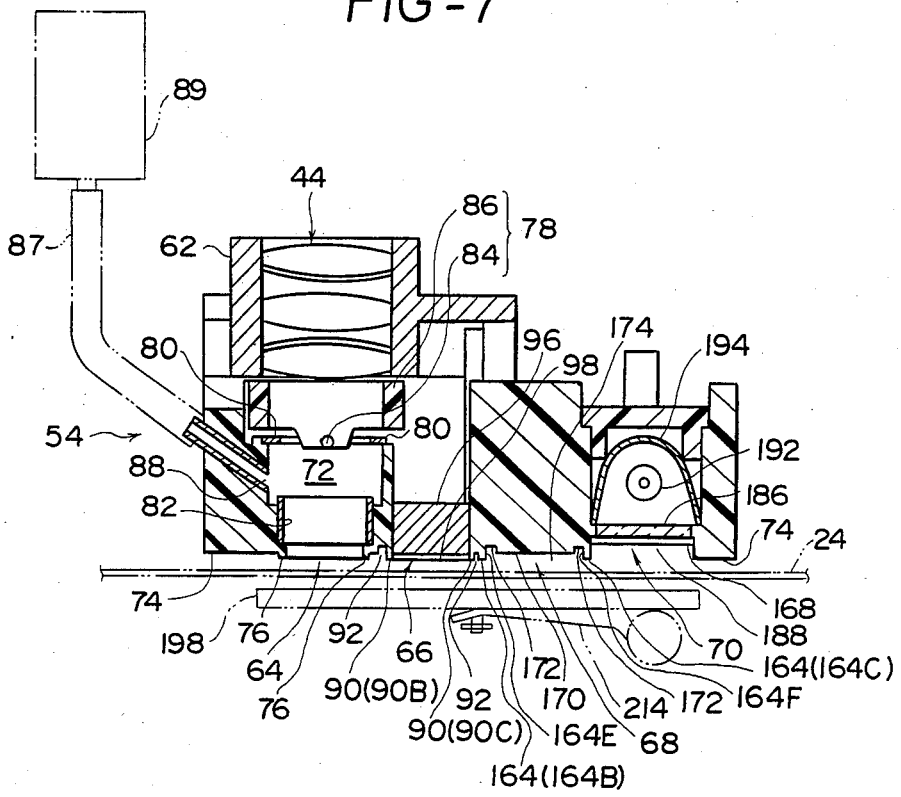
FIG. 7 is a sectional view taken along the line VII—VII in FIG. 6.

The main lens 44 is, as shown in FIGS. 5 and 7, fitted in a lens tube 62 which, in turn, is secured to the rear side of the processing head 54. The electrophotographic film 24 is formed by successively coating a transparent electrically conductive layer, an intermediate layer and a photosensitive layer on a carrier of, e.g., polyethylene. The photosensitive layer consists of a photoconductive layer and a protective layer for protecting the photoconductive layer. This electrophotographic film 24 is formed in the shape of a continuous tape and accommodated in a cassette casing.

Blip marks 24A are printed in advance on the upper edge (as viewed in FIG. 6) of the film 24 at a predetermined regular spacing in the longitudinal direction thereof. Each blip mark 24A is provided in correspondence with one frame for an image which is to be recorded on the film 24. The film 24 is disposed in such a manner that the photosensitive layer side thereof faces the front side of the processing head 54, and is movable in the lateral direction (the horizontal direction as viewed in FIG. 6) of the processing head 54 by driving a film moving motor (not shown). The transparent electrically conductive layer of the film 24 is adapted to provide electrical connection with the apparatus body 10 when the cassette is loaded therein. It is a matter of course that any type of known electrophotographic film may be employed in addition to the film of the type described above.

As shown in FIGS. 5 to 7, a charging exposure section 64, a developing section 66, a drying section 68 and a fixing section 70 are successively formed in the body portion 56 of the processing head 54 along the lateral direction thereof at a constant pitch which corresponds to the frame pitch of the film 24.

Figure 8:
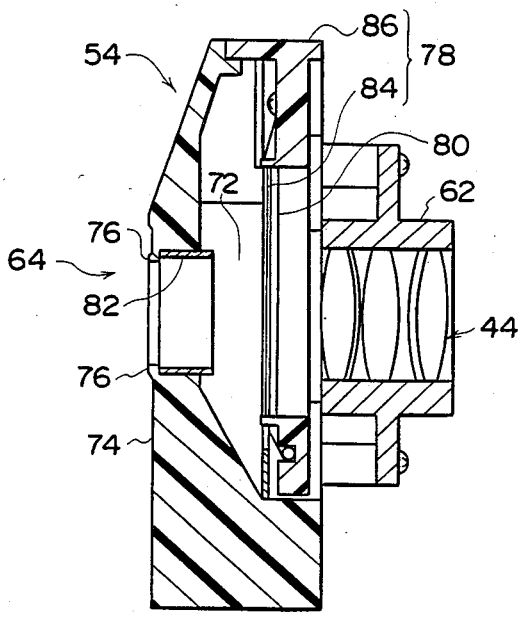
FIG. 8 is a sectional view taken along the line VIII—VIII in FIG. 6.

As shown in FIGS. 7 and 8, the charging exposure section 64 has a charging exposure chamber 72 which is defined by an internal space provided on the reverse side of a front wall 74 of the processing head 54. The chamber 72 is communincated with an opening provided in the front wall 74 of the head 54. As also shown in FIGS. 5 and 6, a mask 76 is formed along the peripheral edge of the opening in the front wall 74, the mask 76 slightly projecting from the surface of the front wall 74. The mask 76 defines a rectangular opening the size of which corresponds to on frame of the film 24. In the charging exposure chamber 72 are disposed a corona unit 78, proximity electrodes 80 and a mask electrode 82.

As shown in FIG. 5, the corona unit 78 consists of a corona wire 84 and a holder 86 made of a synthetic resin and adapted to hold the corona wire 84, the unit 78 being inserted into the processing head 54 from the upper side thereof. The proximity electrodes 80 are respectively defined by relatively narrow metal plates and disposed on both sides of the corona wire 84. The mask electrode 82 is formed by bending a metal plate in a square shape, and disposed in the vicinity of the opening in the front wall 74. The corona wire 84 is connected to a high-voltage power supply, while the proximity electrodes 80 and the mask electrode 82 are electrically connected to each other. In general, the proximity electrodes 80 are connected directly to the ground, while the mask electrode 82 is connected to the ground through an electrical resistance. However, bias voltages which are different from each other may be respectively applied to the proximity and mask electrodes 80 and 82 from an external power supply.

As shown in FIG. 7, a film cooling air inlet 88 is opened into the charging exposure chamber 72 so that cold air is supplied to the chamber 72 with an air pump 89 through a pipeline 87. The main lens 44, which is mounted on the rear side of the processing head 54 through the lens tube 62, has the optical axis thereof made coincident with the center of the opening defined by the mask 76.

As shown in FIGS. 5 and 6, the developing section 66 has a mask 90. The mask 90 is defined by an upper frame member 90A, left and right frame members 90B, 90C, and a lower frame member 90D. The upper frame member 90A and the left and right frame members 90B and 90C rise from the surface of a recess 92 formed in the front wall 74, and the lower frame member 90D rises from the front wall 74. Both longitudinal end portions of the lower frame member 90D project horizontally from the joints between the frame member 90D and the left and right frame members 90B and 90C. The amount by which the mask 90 projects is set so that the mask 90 is flush with the mask 76.

The width of the opening defined by the mask 90 is set such as to be slightly smaller than that of the opening defined by the mask 76. The height of the opening defined by the mask 90, that is, the distance between the respective inner walls of the upper and lower frame members 90A and 90D, is set such as to be larger than that of the opening defined by the mask 76 since the inner wall of the lower frame member 90D is positioned lower than that of the mask 76.

Figure 9:
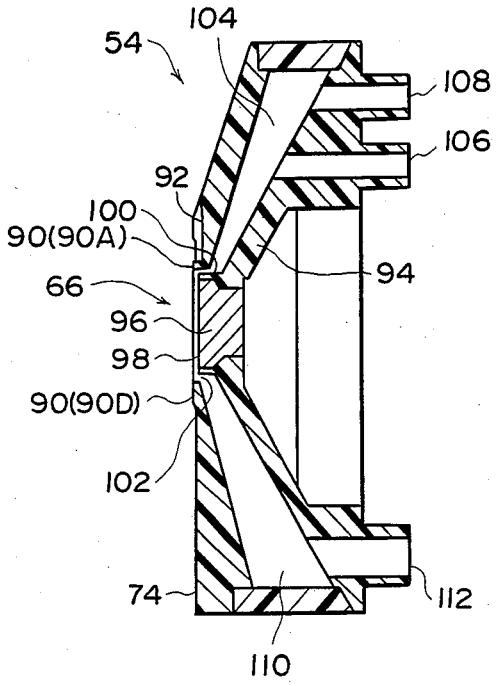
FIG. 9 is a sectional view taken along the line IX—IX in FIG. 6.

As shown in FIG. 9, a developing electrode 96 is disposed within the opening defined by the mask 90, the electrode 96 being supported by a rear wall 94. The developing electrode 96 is connected to a bias power supply. The developing electrode 96 is positioned in such a manner that the outer surface thereof is located at a position which is slightly inward from the end face of the mask 90. The space surrounded by the developing electrode 96 and the inner walls of the mask 90 defines a developing chamber 98. An opening is provided between the upper edge of the electrode 96 and the mask 90 to define a developer and squeezing air inlet 100, and another opening is provided between the lower edge of the electrode 96 and the mask 90 to define a developer and squeezing air outlet 102.

The developer and squeezing air inlet 100 is communicated with a passage 104 which is defined by a space inside the processing head 54. The passage 104 is communicated with a developer supply port 106 and squeezing air supply port 108, which are provided in the rear side of the processing head 54. The developer and squeezing air outlet 102 is communicated with a passage 110 defined by a space inside the processing head 54. The passage 110 is communicated with a developer and squeezing air discharge port 112 which is provided in the rear side of the processing head 54.

Figure 10:
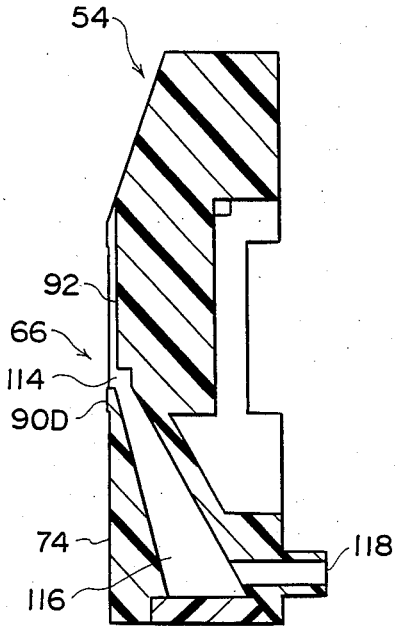
FIG. 10 is a sectional view taken along the line X—X in FIG. 6.

Recesses 92 are respectively provided on the outer sides of the left and right frame members 90B and 90C of the mask 90. As shown in FIGS. 6 and 10, a squeezing suction port 114 is provided at the lower end of each of the recesses 92. The suction ports 114 are, as shown in FIG. 10, communicated with a passage 116 which is defined by a space inside the processing head 54. The passage 116 is communicated with a suction squeeze opening 118 provided in the rear side of the processing head 54.

Referring to FIG. 11(A), the developer supply port 106 is connected to a developer tank 126 by pipelines 122 and 124 through a solenoid valve 120 provided intermediate the pipelines 122 and 124. The developer tank 126 is positioned above the solenoid valve 120. The developer tank 126 is connected through a pipeline 132 to a developer pump 130 activated by a motor 128, the pump 130 being disposed in a developer bottle 134. The developer bottle 134 contains a developer 136 formed by dispersing toner particles in a solvent.

The pipeline 124, which connects together the solenoid valve 120 and the developer tank 126, is branched at the intermediate portion thereof to provide a return pipeline 138 which opens into the developer bottle 134. In addition, a return pipeline 140 which opens into the developer bottle 134 is connected to the developer tank 126.

The squeezing air supply port 108 is connected to a pressure squeezing air pump 144 through a pipeline 142. The developer and squeezing air discharge port 112 is connected with a return pipeline 146 which opens into the developer bottle 134.

As shown in FIG. 11(B), the suction squeeze opening 118 is connected to a suction trap 150 through a pipeline 148. The suction trap 150 is connected to a suction squeezing air pump 154 through a pipeline 152. A return pipeline 156 which opens into the developer bottle 134 is connected to the bottom of the suction trap 150. A valve 158 which is able to close the return pipeline 156 is disposed at the joint between the suction trap 150 and the return pipeline 156. The valve 158 is moved vertically by the action of a solenoid 162 through a shaft 160.

Figure 11:
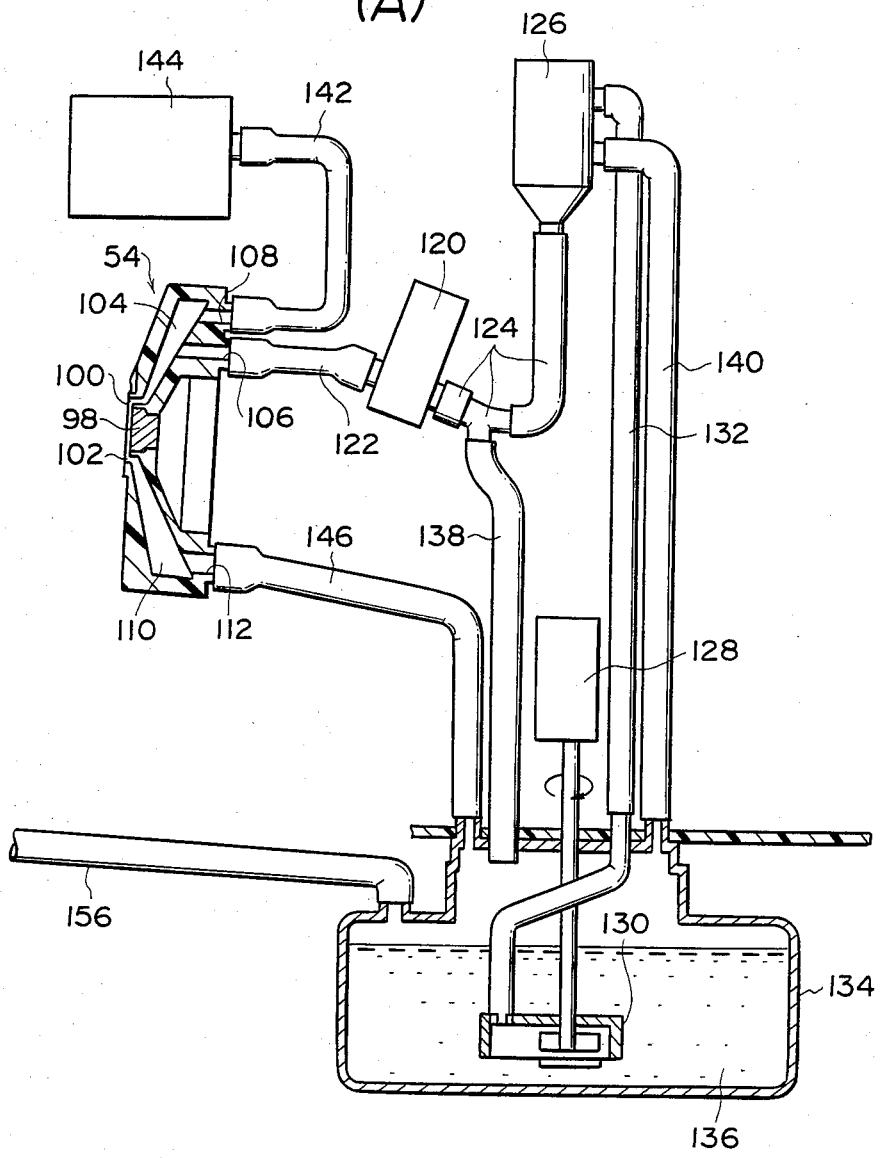
FIGS. 11(A) and 11(B) show the relationship between the developing section in the processing head and its associated devices.
Figure 11:
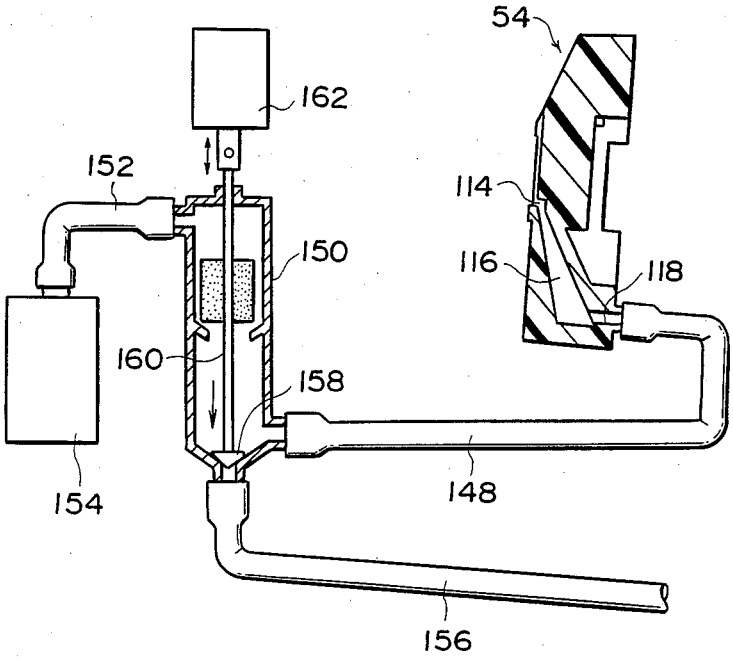

It should be noted that, as shown in FIG. 11, the processing head 54 is inclined with respect to the horizontal plane so that the optical axis of each of the optical systems is perpendicular to the surface of the screen 16 which is slanted.

Referring to FIGS. 5 and 6, the drying section 68 has a frame 164. The frame 164 consists of an upper frame member 164A and left and right frame members 164B and 164C and has no lower frame member, the upper, left and right frame members 164A, 164B and 164C respectively including side walls 164D, 164E and 164F. The left frame member 164B is contiguous with the right-hand end portion of the lower frame member 90D of the mask 90 and rises from the front wall 74 together with the upper frame member 164A.

Figure 12:
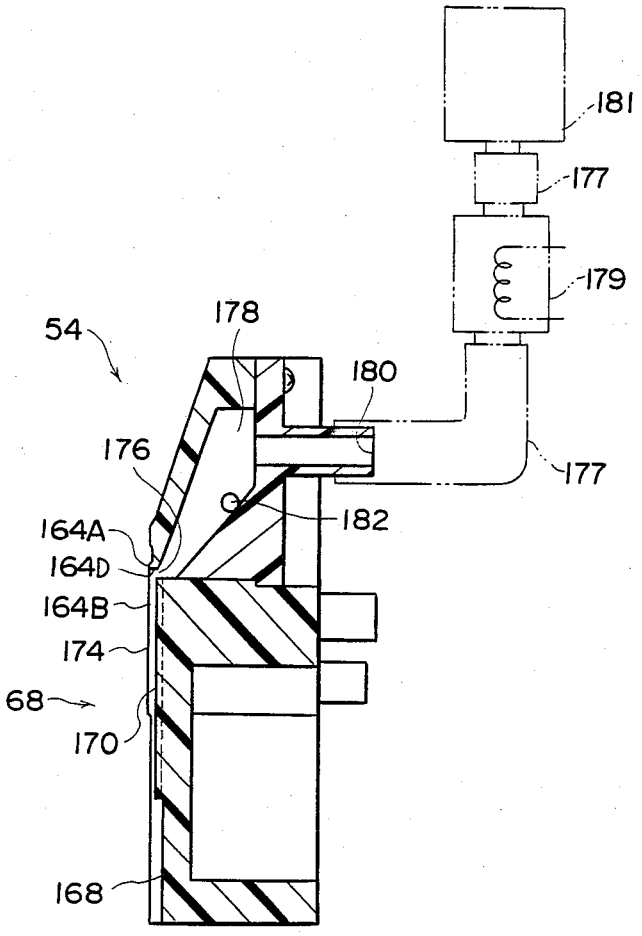
FIG. 12 is a sectional view taken along the line XII—XII in FIG. 6.

As shown in FIGS. 7 and 12, a wall 170 is formed between the respective side walls 164E and 164F of the left and right frame members 164B and 164C in such a manner that the surface of the wall 170 is located at a position which is slightly inward from the end face of the frame 164. In addition, recesses 172 are formed on both sides of the wall 170. The bottom surface of each recess 172 is raised from the wall surface of a recess 168 in the fixing section 70 (described later), the recess 168 being depressed from the front wall 74 in the shape of a step. The space surrounded by the side walls 164D, 164E, 164F, the wall 170, and the recesses 172 defines a drying chamber 174. The distance between the opposing lateral inner surfaces of the frame 164, that is, the distance between the side walls 164E and 164F of the frame 164, is set such as to be larger than the width of the opening defined by the mask 90. In addition, the side wall 164D of the upper frame member 164A is positioned above that of the mask 90 in the developing section 66. Thus, the drying chamber 174 has a larger area than the area defined inside the mask 90 of the developing section 66. The drying chamber 174, designed as described above, is able to dry uniformly the whole area of the electrophotographic fim 24 coated with the developer, including the peripheral portions of each frame coated with the developer by abutting on the mask 90 of the developing section 66, so that drying can be carried out even more effectively.

Although in this embodiment the frame 164 has the shape of a projection, the frame 164 is not necessarily needed to project, and it is only necessary that the width or dimension of the drying chamber 174 in the film advancing direction should be defined by the side walls 164E and 164F.

As shown in FIGS. 6 and 12, the lower portion of the upper frame member 164A is cut in the shape of a slit along the longitudinal direction of the frame member 164A, thereby providing a warm air outlet 176. The warm air outlet 176 is, as shown in FIG. 12, communicated with a passage 178 which is defined by a space inside the processing head 54. The passage 178 is communicated with a warm air supply port 180 which is provided in the rear side of the processing head 54. A temperature sensor 182 is disposed in the passage 178. The warm air supply port 180 is connected to a heater 179 and an air pump 181 through a pipeline 177.

The fixing section 70 is, as shown in FIGS. 5 to 7, defined between the right frame member 164C of the frame wall 164 and the right-hand end portion of the front wall 74. The fixing section 70 has a frame 184 which consists of a lower frame member and left and right frame members, the frame 184 being located at a position which is further depressed from the recess 168 in the front wall 74. A transparent glass plate 186 is fitted in the frame 184. The space provided on the front side of the glass plate 186 defines a fixing chamber 188.

Figure 13:
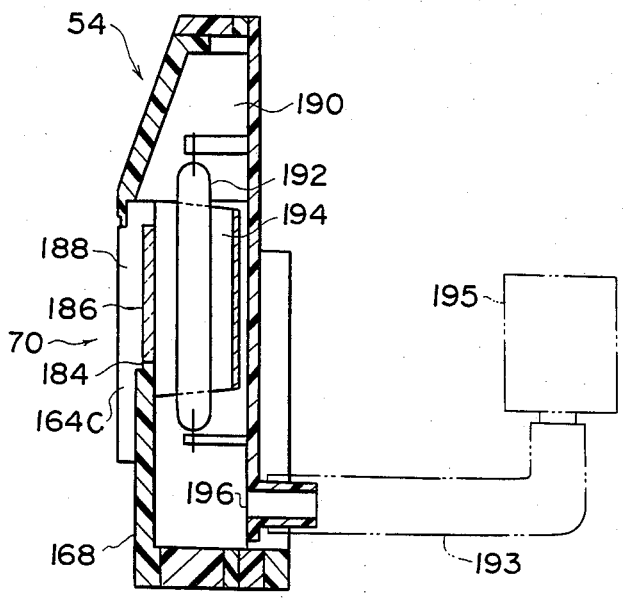
FIG. 13 is a sectional view taken along the line XIII—XIII in FIG. 6.

As shown in FIG. 13, a xenon lamp 192 and a reflecting plate 194 are disposed within a space 190 inside the processing head 54 on the inner side of the glass plate 186. A cooling air inlet 196 opens into the space 190 so that cold air is supplied to the space 190 from an air pump 195 through a pipeline 193. The space 190 and the fixing chamber 188 are communciated with each other through the area defined at the upper edge of the glass plate 186.

Referring to FIGS. 5 and 6, the processing head 54 has a blip sensor 196 which is disposed on the left-hand end portion of the front wall 74. The blip sensor 196 is located at a position at which the blip marks 24A printed on the electrophotographic film 24 pass, the film 24 being moved along the front side of the processing head 54. Thus, when each blip mark 24A passes, the blip sensor 196 detects interception of the light from a light source for the sensor 196 which is disposed in opposing relation to the sensor 196 across the film 24.

Figure 15A:
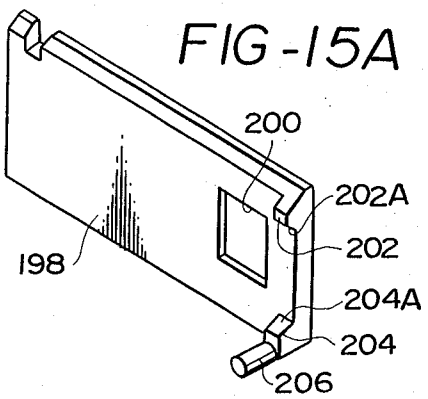
FIG. 15A is a perspective view of one of the elements shown in FIG. 15, as viewed from the opposite side.
Figure 15:
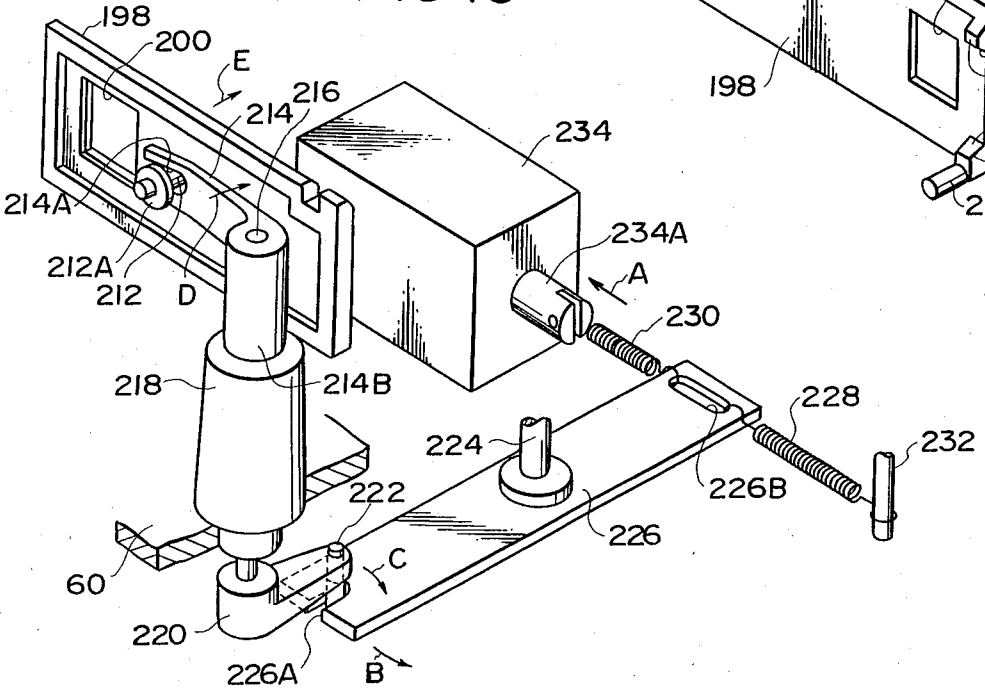
FIG. 15 is a perspective view of a film pressing mechanism disposed on the processing head.

As shown in FIGS. 7 and 15, a pressing plate 198 is disposed in front of the front wall 74 of the processing head 54. The pressing plate 198 is, as shown in FIG. 15, provided with a rectangular through-hole 200 which is a size smaller than the opening defined by the mask 76 formed in the charging exposure section 64. The pressing plate 198 is disposed in such a manner that the through-hole 200 opposes the mask 76.

Figure 14:
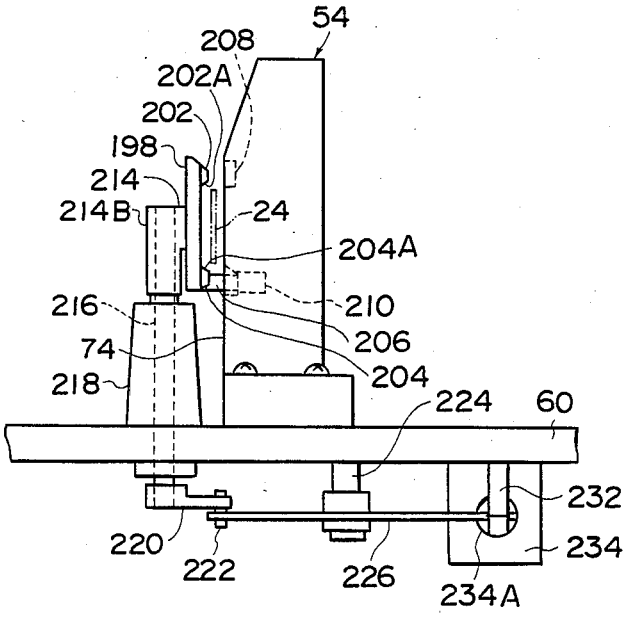
FIG. 14 is a schematic side view showing the positional relationship between the processing head and a pressing plate.

As will be clear from FIG. 15A (a perspective view of the pressing plate 198 shown in FIG. 15, as viewed from the opposite side), the pressing plate 198 has fitting members 202 and 204 respectively formed on the upper and lower end portions on the side of the plate 198 which is closer to the through-hole 200, the fitting members 202 and 204 projecting toward the processing head 54. The opposing inner surfaces of the fitting members 202 and 204 are slanted as at 202A and 204A. The distance between the respective root portions of the upper and lower fitting members 202 and 204 is set such as to be equal to the width of the electrophotographic film 24 (strictly speaking, said distance being slightly larger than the width of the film 24), as shown in FIG. 14. A columnar portion 206 projects from the distal end of the fitting member 204. The fitting members 202 and 204 are able to be fitted into bores 208 and 210, respectively, formed in the front wall 74 of the processing head 54, as shown in FIGS. 5, 6 and 14.

The pressing plate 198 has a columnar portion 212 projecting from the reverse surface thereof, that is, the surface thereof which is remote from the procesing head 54. This columnar portion 212 is engaged with a notched portion 214A formed at one end portion of an arm 214. A stop ring 212A is rigidly secured to the distal end portion of the columnar portion 212 so as to prevent the notched portion 214A from coming off the columnar portion 212. A boss portion 214B is formed at the other end of the arm 214. A shaf 216 is rigidly secured to the boss portion 214B.

The shaft 216 is rotatably fitted into and thereby supported by a stand 218 projecting from the frame 60 to which the processing head 54 is secured, the lower end portion of the shaft 216 projecting from the reverse surface of the frame 60. A first lever 220 is rigidly secured to the projecting lower end portion of the shaft 216. A pin 222 is rigidly secured to the distal end portion of the first lever 220.

A shaft 224 is suspended from the reverse side of the frame 60. The shaft 224 pivotally supports the intermediate portion of a second lever 226. A notched portion 226A is formed at one end of the second lever 226, and the pin 222 is engaged with the notched portion 226A. A slot 226B is formed in the other end portion of the second lever 226, and one end portion of each of the tension coil springs 228 and 230 is retained by the slot 226B, the springs 228 and 230 biasing the second lever 226 in the opposite directions to each other so as to support the lever 226 resiliently.

The other end portion of the tension coil spring 228 is retained by a pin 232 suspended from the reverse side of the frame 60, while the other end portion of the tension coil spring 230 is retained by a plunger 234A of a pull-type solenoid 234 which is secured to the reverse side of the frame 60.

When the solenoid 234 is not energized, the pressing plate 198 is separated from the processing head 54. In this state, the pressing plate 198 is supported in such a manner that the columnar portion 206 is fitted into the bore 210 as shown in FIG. 14.

When the solenoid 234 is energized, the plunger 234A is activated to move in the direction of the arrow A, causing the tension coil springs 228 and 230 to be expanded against the biasing forces. In consequence, the second lever 226 is pivoted about the shaft 224 in the direction of the arrow B, so that the first lever 220 is pivoted about the pin 222 in the direction of the arrow C, thus causing the shaft 216 to turn in the same direction. Thus, the arm 214 is pivoted in the direction of the arrow D so as to press the pressing plate 198 in the direction of the arrow E.

The pressing plate 198 is moved in the direction of the arrow E while the columnar portion 206 is being guided by the bore 210, thus causing the film 24 to be pressed against the end faces of the masks 76, 90 and the frame wall 164. When the heightwise position of the film 24 is misaligned, the respective slanted surfaces of the fitting members 202 and 204 act so as to push down the upper edge of the film 24 or push up the lower edge thereof as the pressing plate 198 is moved in the direction of the arrow E.

When the pressing plate 198 is pressing the film 24 against the processing head 54, the fitting members 202 and 204 are respectively fitted in the bores 208 and 210, so that the film 24 is accurately positioned with respect to the processing head 54. In this state, the pressing plate 198 is allowed to resiliently press the film 24 by the action of the tension coil springs 228 and 230.

When the solenoid 234 is de-energized, the second lever 226, which is subjected to the biasing force from the spring 228, is pivoted counter to the direction of the arrow B. In consequence, the arm 214 is pivoted counter to the direction of the arrow D, so that the notched portion 214A presses the stop ring 212A, causing the pressing plate 198 to move counter to the direction of the arrow E.

The following is a description of the operation of this embodiment.

The electrophotographic apparatus is arranged such that, when the power supply switch is turned ON, the cassette loading section 26 (shown in FIG. 1) is raised, thereby allowing a cassette accommodating the electrophotographic film 24 to be loaded into the section 26. After the cassette has been loaded into the cassette loading section 26, the operator pushes down the section 26 to the initial position by a manual operation. In consequence, the cassette loading section 26 is locked at said position. In this state, the film 24 is positioned as shown in FIG. 14 and is allowed to move along the front side of the processing head 54 by the operation of a film moving motor (not shown).

When the image of the document 34 (shown in FIG. 2) is to be recorded on the film 24, the film moving motor is activated to move the film 24 in such a manner that a given frame which is selected from the unexposed frames as desired is positioned in front of the mask 76 in the charging exposure section 64. This operation is executed by designating a desired frame through the control keyboard 28 shown in FIG. 1. The positioning of the selected frame with respect to the charging exposure section 64 is effected by virtue of the blip sensor 196 which counts the number of blip marks 24A from a reference point.

FIG. 16 is a time chart showing the operation of the apparatus in the case where a given frame is positioned as described above and subjected to recording and, subsequently, continuous recording is effected on each of the frames which are consecutively follow the first recorded frame. In the processing head 54, when the frame positioned at the charging exposure section 64 is being subjected to charging and exposure operations, frames which are respectively positioned at the developing section 66, the drying section 68 and the fixing section 70 are simultaneously subjected to different kinds of processing, respectively. However, the following description will be made about only one frame which is to be subjected to recording when the recording button is pressed at the position (I) in FIG. 16 to start recording.

Recording of the document 34 is made possible by selecting the camera mode through the control keyboard 28. Simultaneously with this mode selecting operation, a bias voltage is applied to the developing electrode 96 in the developing section 66, the heater 179 for heating air sent to the drying chamber 174 is energized so as to generate heat, and a capacitor for the xenon lamp 192 in the fixing section 70 is supplied with current so as to be charged. These operations are continued while the camera mode is being selected.

When the recording button on the control keyboard 28 is pressed, a high voltage is applied to the corona wire 84 in the charging exposure section 64, causing a corona discharge to occur between the corona wire 84 on one hand and the proximity and mask electrodes 80 and 82 on the other. Thus, the surface of the photosensitive layer of a portion of the film 24 which is positioned within the opening defined by the mask 76 is charged positive.

At the time when the recording button is pressed, the solenoid 234 in the film pressing mechanism has continuously been excited from the previous step. Therefore, the film 24 is pressed by the pressing plate 198 so as to be in pressure contact with the respective end faces of the masks 76, 90 and the frame wall 164 of the processing head 54. The pressing plate 198 has the through-hole 200 formed in a portion thereof which opposes the mask 76, but this through-hole 200 is smaller than the opening defined by the mask 76. Therefore, a portion of the film 24 which is positioned at the end face of the mask 76 is pressed by the surface of a portion of the pressing plate 198 around the through-hole 200. Accordingly, the film 24 is reliably brought into close contact with the end face of the mask 76, and the charging range is thereby accurately limited within the opening in the mask 76.

Since the mask electrode 82 provided in the charging exposure chamber 72 is maintained at a potential substantially equal to the potential of the charged film 24, the peripheral edge portion of a frame of the film 24 which is positioned at the opening in the mask 76 is also charged at a value close to the potential at the central portion of said frame, thus enabling the whole of a frame of the film 24 to be uniformly charged. The mask electrode 82 can be maintained at a potential substantially equal to the potential of the charged film 24 by appropriately selecting the value of a resistor (not shown) electrically connected between the ground and the mask electrode 82, or by applying a bias voltage to the mask electrode 82 from an external power supply (not shown).

The document illuminating lamp 36 is turned ON when a predetermined period of time has elapsed after the recording button has been pressed at the position (I) in FIG. 16, so as to illuminate the document 34 placed on the glass plate 22 of the document table 18. Further, when a predetermined period of time has elasped after the recording button has been pressed, the supply of current to the corona wire 84 is suspended, thus completing the corona discharge operation.

At the same time as the suspension of the energization of the corona wire 84, a shutter (not shown but indicated by the reference symbol A in FIG. 16) is opened, and the light reflected from the document 34 placed on the document table 18 is applied to the film 24 by the optical system shown in FIG. 2. In addition, the automatic exposure controller (not shown but indicated by the reference symbol B in FIG. 16) simultaneously starts integration of the quantity of light.

On the other hand, when a predetermined period of time has elapsed after the recording button has been pressed, the motor 128 shown in FIG. 11(A) is activated to start the operation of the developer pump 130, whereby the developer 136 in the developer bottle 134 is pumped up into the developer tank 126. The developer 136 in the tank 126 gravitationally lowers and passes through the pipeline 124 toward the processing head 54. However, since the solenoid valve 120 has not yet been opened at that time, the developer 136 is returned to the developer bottle 134 through the return pipeline 138. When the level of the developer 136 in the tank 126 excessively rises, the developer 136 is returned to the developer bottle 134 through the return pipeline 140.

In this way, until the solenoid valve 120 is opened, the developer 136 circulates between the developer bottle 134 and the developer tank 126, and while doing so, the developer 136 stands by at a position immediately before the solenoid valve 120. This circulation causes the developer 136 in the developer bottle 134 to be stirred.

When the integrated value of the quantity of light reaches a set value, the integration effected by the automatic exposure controller (B) is suspended and, at the same time, the shutter (A) is closed, and the document illuminating lamp 36 is turned OFF. At this point of time, the exposure step is completed and, one frame of the film 24 in a portion thereof which is positioned at the opening defined by the mask 76 has an electrostatic latent image formed thereon owing to the fact that the electric charge on the photosensitive layer is reduced in accordance with the image pattern on the document 34. Since factors in changes of the image density, such as variations in the ground density of the document 34 and variations in the voltage applied to the document illuminating lamp 36, are corrected by the automatic exposure controller (B), an optimal exposure operation is effected at all times. When a predetermined period of time has elapsed after the recording button has been pressed and all the steps of processing other frames have already been completed, the solenoid 234 of the film pressing mechanism is immediately de-energized. When the solenoid 234 is de-energized at the position (IA) in FIG. 16, the pressing plate 198 is separated from the film 24.

At the same time as the solenoid 234 of the film pressing mechanism is de-energized, the solenoid 162 of the suction trap 150 shown in FIG. 11(B) is energized to raise the valve 158 through the shaft 160, thus allowing the return pipeline 156 to be communicated with the suction trap 150. In consequence, the developer 136 which has been trapped by the suction trap 150 during the previous developing and squeezing step (described later) is returned to the developer bottle 134.

When a predetermined period of time has elapsed after the solenoid 234 of the film pressing mechanism has been deenergized, the film moving motor (not shown but indicated by the reference symbol C in FIG. 16) is activated to move the film 24 rightwardly as viewed in FIG. 6 by a distance corresponding to one frame. Thus, the frame which has been positioned at the charging exposure section 64 is moved to the developing section 66. The movement of the film 24 by one frame is controlled by the blip sensor 196 in a manner similar to the above. More specifically, the movement of the film 24 is suspended when the sensor 196 detects a subsequent blip mark 24A.

When a predetermined period of time has elapsed after the film moving motor (C) has been suspended, the solenoid 234 of the film pressing mchanism is energized at the position (IB) in FIG. 16, so that the film 24 is pressed against the processing head 54 by the pressing plate 198. At the same time, the solenoid 162 of the suction trap 150 is de-energized so as to close the return pipeline 156, and the suction squeezing air pump 154 is activated. In addition, the solenoid valve 120 is opened.

When the solenoid valve 120 is opened, the developer 136 is allowed to reach the processing head 54 through the pipeline 122, and the developer 136 then flows into the developing chamber 98 from the developer and squeezing air inlet 100 in the developing section 66. Since the toner particles dispersed in the developer 136 are charged negative, the toner particles, when flowing down through the developing chamber 98, adhere to portions of the film 24 which are charged positive, thereby developing the electrostatic latent image. The developer 136 having flowed down through the developing chamber 98 is returned to the developer bottle 134 from the developer and squeezing air outlet 102 through the return pipeline 146.

The diameter or the like of each of the pipelines is set so that a part of the developer 136 supplied to the pipeline 124 from the developer tank 126 is returned to the developer bottle 134 through the return pipeline 138, and the remaining developer 136 advances toward the solenoid valve 120.

Since the film 24 is pressed against the end face of the mask 90 by virtue of the pressing plate 198, substantially no developer 136 enters the gap between the end face of the mask 90 and the film 24 when the developer 136 flows down through the developing chamber 98. Any developer 136 which enters said gap is sucked and trapped into the suction trap 150 from the squeeze suction port 114 through the pipeline 148 by means of a vacuum produced in each of the recesses 92 which are respectively located on the outer sides of the left and right frame members 90B and 90C of the mask 90, the vacuum being produced by the action of the suction squeezing air pump 154.

When a predetermined period of time has elapsed after the solenoid 234 of the film pressing mechanism has been energized, the drive of the motor 128 is suspended, and the operation of the developer pump 130 is consequently suspended. However, the solenoid valve 120 remains opened thereafter. Since the developer 136 is gravitationally supplied from the developer tank 126 to the processing head 54, even when the operation of the developer pump 130 is suspended, the supply of the developer 136 to the developing chamber 98 is continued. It is therefore possible to minimize possible exposure blur which may be caused by vibrations of the developer pump 130 during the exposure of a subsquent frame.

When a predetermined period of time has elapsed after the solenoid valve 120 has been opened, the valve 120 is closed to suspend the supply of the developer 136 to the developing chamber 98. At the same time, the pressure squeezing air pump 144 shown in FIG. 11(A) is activated to supply pressurized air to the developing chamber 98 from the developer and squeezing air inlet 100, whereby surplus developer 136 attached to the film 24 is blown off. The developer 136 thus blown off is returned to the developer bottle 134 from the developer and squeezing air outlet 102 through the return pipeline 146.

The supply of the pressurized air to the developing chamber 98 is controlled in such a manner that a relatively weak blast is applied while a relatively large amount of developer 136 remains in the developing chamber 98 in order to prevent deterioration of the quality of the image which would otherwise be caused by an operation of blowing off the developer 136 at high speed. When a predetermined period of time has elasped after the application of the blast has been started, a relatively strong blast is applied to increase the squeezing efficiency.

The application of the blast is controlled by the charging exposure step for a subsequent frame which has been started in response to the pressing of the recording button at the position (II) in FIG. 16. The application of the blast is suspended at the same time as the drive of the film moving motor (C) is started at the time when a predetermined period of time has elapsed after the solenoid 234 of the film pressing mechanism has been de-energized at the position (IIA) in FIG. 16, thus completing the developing and squeezing step.

It should be noted that the presence of the developing electrode 96 during the developing operation enables obtaining of an image having no edge effect. In addition, the application of a bias voltage to the developing electrode 96 prevents fogging of the image.

When the drive of the film moving motor (C) is suspended, the film 24 has been moved rightwardly as viewed in FIG. 6 by an amount corresponding to one frame, so that a frame which has been positioned at the developing section 66 is now positioned at the drying section 68. When a predetermined period of time has elapsed after the drive of the film moving motor (C) has been suspended, the solenoid 234 of the film pressing mechanism is energized at the position (IIB) in FIG. 16 and, at the same time, the air pump 181 shown in FIG. 12 is activated. In consequence, the air heated by the heater 179 is blown into the drying chamber 174 from the warm air outlet 176 in the drying section 68, and the developer 136 is thereby dried. The operation of the air pump 181 is controlled by the charging exposure step which is started when the recording button is pressed at the position (III) in FIG. 16, and suspended at the same time as the solenoid 234 of the film pressing mechanism is de-energized at the position (IIIA) in FIG. 16, thus completing the drying step.

The film 24, which has been squeezed in the developing section 66 as described above and is positioned at the drying section 68, normally has no surplus developer attached to the surface thereof. However, when the surplus developer is trapped by dust or the like which is attached to the surface of the film 24 and therefore the surplus developer cannot sufficiently been swished off, the film 24 which is moved from the developing section 66 and positioned at the drying section 68 has the surplus developer attached to the surface thereof. When the solenoid 234 is energized so as to cause the pressing plate 198 to press the film 24 in such condition, the surplus developer is compressed and flattened between the film 24 and the wall 170, and the developer is thereby caused to spread to the periphery.

Figure 17:
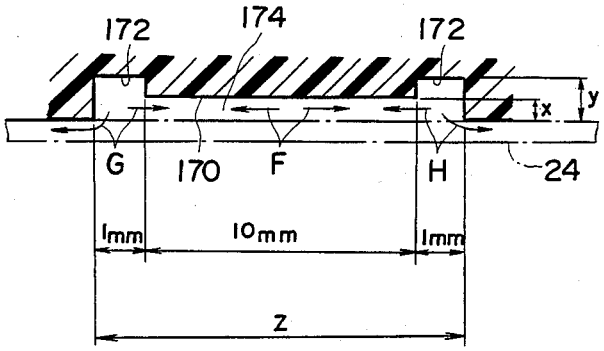
FIG. 17 is a schematic sectional view of the drying section, which shows the operation thereof.

As described above, warm air is started to pass through the drying chamber 174 at the same time as the movement of the pressing plate 198 is started. Since the cross-sectional area of the air passage defined by the recesses 172 is larger than that of the other portions, the flow rate of the warm air which passes through the recesses 172 is higher than that of the other portions. Accordingly, as shown in FIG. 17, the surplus developer which is spread, for example, horizontally (in the direction of the arrows F) from the center of the drying chamber 174 is blocked by the warm air passed through the recesses 172, so that there is no fear of the developer spreading furthermore. When the surplus developer is first located at a position which opposes either the left- or right-hand recess 172, it is immediately blown off at said position. Therefore, there is no fear of the developer spreading in the direction of the arrow G or H. The wall surfaces of the recesses 172 contacted by the surplus developer is quickly dried.

Even when the developer 136 enters the drying chamber 174 from the developing chamber 98 which is adjacent thereto, the developer 136 is immediately blown off by means of the warm air being passed through the recess 172 which is located closer to the developing chamber 98. Similarly, when matter which is vaporized in the fixing chamber 188 enters the drying chamber 174 as described later, it is trapped by the warm air being passed through the recess 172 located closer to the fixing chamber 188 and the foreign matter is thereby immediately discharged.

The temperature of the warm air which is supplied to the drying chamber 174 is detected by the temperature sensor 182, and when the temperature is out of a predetermined range, this fact is displayed on the control keyboard 28. When the temperature of the warm air is excessively high, the supply of current to the heater 179 is immediately suspended.

Although in the above-described embodiment the drying air pump 181 is activated in response to the energization of the solenoid 23 of the film pressing mechanism and only when the film 24 is being pressed against the processing head 54, the air pump 181 may be operated at all times from the start of the operation of the apparatus.

After the solenoid 234 of the film pressing mechanism has been de-energized at the position (IIIA) in FIG. 16, the film moving motor (C) is activated, and the frame which has been positioned at the drying section 68 is thereby moved to the fixing section 70. After the drive of the film moving motor (C) has been suspended, the solenoid 234 of the film pressing mechanism is energized at the position (IIIB) in FIG. 16 and, at the same time, the air pump 195 shown in FIG. 13 is activated to supply cold air to the space 190 in the fixing section 70. The cold air supplied to the space 190 passes through the area defined at the upper edge of the glass plate 186 to reach the fixing chamber 188.

When a predetermined period of time has elapsed after the solenoid 234 of the film pressing mechanism has been energized, the xenon lamp 192 is turned ON, so that the toner particles are fused and fixed to the surface of the film 24, thus completing the fixing step.

Any matter which is vaporized or scattered during the fixing operation is blown off by means of the cold air supplied from the air pump 195, and there is no fear of such matter adhering to the surface of the glass plate 186.

When the above-described steps are finished, the recording of an image on the electrophotographic film 24 is completed.

In the apparatus according to this embodiment, when the recording button is pressed, recording is started, and after the recorded frame positioned at the charging exposure section 64 has been moved to the developing section 66 and when a predetermined period of time has elapsed after the solenoid 234 of the film pressing mechanism has been energized, it becomes possible to record a subsequent frame. To effect continuous recording of following consecutive frames, the recording button is pressed during the period which begins when it becomes possible to record a subsequent frame and which ends when a predetermined period of time has elapsed after the completion of the application of a relatively weak blast to the developing section 66 by the pressure squeezing air pump 144. In consequence, the recording step is repeated, and the processing proceeds as shown in FIG. 16.

When the recording button is not pressed during said period, or when the command to end a series of recording operations is input from the control keyboard 28, the application of a relatively strong blast by the air pump 144 is suspended in accordance with the operation of a timer, and the drying and fixing operations carried out thereafter are also executed in accordance with the timer.

When the reader mode is selected, it is possible to project the film 24 having images of documents recorded thereon as described above. The electrophotographic apparatus in accordance with this embodiment is arranged such that, when a cassette is loaded in the same way as the above, the reader mode is automatically selected (the third mirror 38 has already been moved from the position shown in FIG. 2 to another position). When a given frame is moved to and stopped at the charging exposure section 64 by an operation similar to the above, the light source of the projecting light source section 46 shown in FIG. 3 is turned ON. The light from the light source is passed through the through-hole 200 provided in the pressing plate 198 and transmitted by the film 24, and the image recorded on the film 24 is enlarged and projected on the screen 16 by the optical system shown in FIG. 3.

At the same time as the light source is turned ON, the air pump 89 shown in FIG. 7 is activated to supply cold air to the charging exposure chamber 72 so as to cool the film 24, thereby preventing the film 24 from being heated to high temperature by the heat from the projecting light source section 46, and thus avoiding any out-of-focus problem due to thermal deformation of the film 24.

In the reader mode, it is possible to continuously view projected images of the film 24 within a short period of time by successively advancing the film 24 for each frame through the control keyboard 28. In such case, every time the film 24 is moved, the shutter (A) is closed in order to prevent flickering due to persistence phenomenon.

When the copy button on the control keyboard 28 is pressed while an image is being projected on the screen 16, the copy mode is selected. In consequence, the copy mirror 52 is moved, and the image being projected on the screen 16 is recorded on a sheet of copying paper 30 by the optical system shown in FIG. 4.

The following is a description of a practical example of the drying chamber 174 in accordance with the present invention. The size of the drying chamber 174 and the flow rate and pressure of air supplied into the chamber 174 may be determined as follows.

In the practical example, an electrophotographic film 24 which is 16 mm electrophotographic film of a roll type and which has a frame size, i.e., the dimension of each frame in the film advancing direction, of 9 to 10 mm was employed.

In that case, x, y and z in FIG. 17 were set at 0.5 mm, 1 mm and 12 mm, respectively, and the width of each recess 172 was set at 1 mm. The flow rate of air and the air pressure were selected to be 6 l/min and 200 to 300 $mmH_2O$, respectively. Under this set of conditions, it was possible to obtain excellent results. The longitudinal size of each frame of the film 24 employed in the practical example was about 12 mm.

It should be noted that the size of the drying chamber 174 and the flow rate and pressure of drying air are not necessarily limitative to the above-described values. For example, in the case where the frame size is set at the above-described value, the following values may preferably be selected: 0.2 to 2 mm for x; 1.5 to 5 times the value of x for y; a value obtained by 110 to 160% increasing the above-described frame size in the film advancing direction for z; 3 to 12 l/min for the air flow rate; and 50 to 700 $mmH_2O$ for the air pressure.

As described above, in this embodiment the recesses 172 are formed on both sides, respectively, of the wall 170 in the drying chamber 174, and the distance between the wall 170 and the surface of the electrophotographic film 24 is relatively short. Therefore, the air resistance at this portion is higher than that at the recesses 172, and because of this difference in terms of air resistance, the flow rate of the warm air passed through the recesses 172 is higher than that at the other portions.

Accordingly, any developer remaining on the film 24 which has not sufficiently been squeezed after development is forced to flow down through the recesses 172 in the drying chamber 174 by means of the warm air passed through the recesses 172. In addition, it is possible, by virtue of the existence of the recesses 172, to prevent any surplus developer from being spread over the area between the surface of the electrophotographic film 24 and the wall 170 by the action of surface tension. Even when the surplus developer adheres to the wall surfaces of the recesses 172, since a relatively large amount of warm air is passed through the recesses 172, the wetted wall surfaces are quickly dried, so that it is possible to prevent any surplus developer from spreading in the direction of the arrow G or H in FIG. 17.

Even when matter which is vaporized in the fixing chamber 188 enters the drying chamber 174, it is trapped by the warm air being passed through the recess 172 of the drying chamber 174 which is located closer to the fixing chamber 188 and the foreign matter is thereby immediately discharged to the lower side of the drying chamber 174. Thus, there is no fear of the images formed on the electrophotographic film 24 being affected by such foreign matter.

Although in the above-described embodiment a pair of recesses are provided on both sides, respectively, of the opposing wall, the arrangement may be such that a recess is provided only on the side of the opposing wall which is closer to the developing section.

Further, although a microfilm in the shape of a roll is employed in the above-described embodiment, it is not necessarily limitative, and fiche film may also be used in the present invention.

In addition, the present invention may be applied not only to microfilms but also to any type of film which is subjected to development and drying for each frame or each predetermined region in wet-type electrophotographic apparatuses.

Although the present invention has been described through specific terms, it should be noted here that the described embodiment is not exclusive and various changes and modifications may be imparted thereto without departing from the scope of the invention which is limited solely by the appended claims.

What is claimed is:

1. A processing head for an electrophotographic apparatus, comprising:

(a) a developing section (66) for developing an electrophotographic film (24) with a liquid developer (136);

(b) a drying section (68) disposed adjacent to and on a downstream side of said developing section in a direction in which the film is advanced, said drying section having a central wall (170) disposed opposite said film and a pair of flanking first side walls (164E, 164F) individually disposed on opposite sides of said central wall and extending in a transverse direction which intersects the film advancing direction such that said central wall, said first side walls and said film define in combination a space (174) surrounded thereby through which gas for drying is passed in a transverse direction which intersects the film advancing direction, thereby drying said film wetted with the developer; and (c) a recess (172) defined between said central wall and a one of said first side walls closest to said developing section such that said recess extends in the direction in which said drying gas is passed.

2. A processing head according to claim 1, further comprising a further recess (172) defined between said central wall and another of said first side walls which is most remote from said developing section such that said further recess extends in the direction in which said drying gas is passed.

3. A processing head according to claim 2, wherein each of said first side walls defines a part of a frame in the shape of a projection.

4. A processing head according to claim 2, wherein said first side walls and a second side wall (164D) which connects one longitudinal end portion of one of said first side walls to that of the other define in combination a U-shaped wall around said central wall.

5. A processing head according to claim 4, wherein an outlet (176) for said drying gas is formed in an area between said second side wall and said central wall.

6. A processing head according to claim 5, wherein said outlet has the shape of a slit which extends along said second side wall.

7. A processing head according to claim 6, wherein said gas is warm air.

8. A processing head according to claim 7, wherein a heater for heating said gas is interposed between a feed pump which feeds said gas and said outlet.

9. A processing head for use in an electrophotographic apparatus for recording a frame image on an electrophotographic microfilm, comprising:

(a) a charging exposure section (64) in which said microfilm is charged, and wherein the frame image is formed thereon by light exposure;

(b) a developing section (66) disposed adjacent to and on a downstream side of said charging exposure section in a direction in which said microfilm is advanced, said developing section being adapted to develop said exposed microfilm with a liquid developer;

(c) a drying section (68) disposed adjacent to and on a downstream side of said developing section in the microfilm advancing direction, said drying section having a central wall (170) disposesd opposite the surface of said microfilm and a pair of flanking side walls (164E, 164F) individually disposed on opposite sides of said central wall and extending in a direction substantially perpendicular to the microfilm advancing direction such that said central wall, said side walls and the surface of said microfilm define in combination a drying chamber (174) surrounded thereby through which gas for drying is passed in a direction substantially perpendicular to the microfilm advancing direction, thereby drying said microfilm developed with the developer, and said drying section further having a pair of recesses (172) individually defined between said central wall and said side walls and extending in the direction in which said gas is passed; and (d) a fixing section (70) disposed adjacent to and on a downstream side of said drying section in the microfilm advancing direction to fix the frame image on said dried microfilm, whereby the flow rate of said gas passed through the recesses is made higher than that of the gas passed along said central wall, so that it is possible to prevent said developer from spoiling a frame image which is adjacent to said frame image.

10. A processing head according to claim 9, wherein said side walls and an upper side wall (164D) which connects together the upper end portions of said side walls define in combination a U-shaped wall around said central wall.

11. A processing head according to claim 9, wherein each of said side walls defines a part of a frame in the shape of a projection.

12. A processing head according to claim 10, wherein an outlet from (176) for said gas is formed in an area between said upper side wall and said central wall.

13. A processing head according to claim 11, wherein said outlet has the shape of a slit which extends along said upper side wall.

14. A processing head according to claim 12, wherein said outlet is communicated with a pump which feeds said gas.

15. A processing head according to claim 13, wherein said gas is warm air.

16. A processing head according to claim 14, wherein a heater for heating said gas is interposed between said feed pump and said outlet.

17. A processing head according to claim 15, wherein a temperature sensor for detecting the temperature of said warm air is disposed between said outlet and said heater.

18. A processing head for an electrophotographic apparatus, comprising:

(a) a developing section (66) for developing an electrophotographic microfilm (24) with a liquid developer (136);

(b) a drying section (68) disposed adjacent to and on a downstream side of said developing section in a direction in which said microfilm is advanced, to dry said microfilm wetted with said developer by means of a gas for drying which is passed through said drying section in a transverse direction that intersects the microfilm advancing direction, two opposite ends of said drying section in the microfilm advancing direction being respectively defined by a pair of first side walls (164E, 164F) extending in the direction in which said gas is passed; and (c) a pair of recesses (172) individually formed in close proximity with said first side walls and extending therealong, the flow rate of said gas passed through said recesses being higher than that of the gas passed along a central portion (170) of said drying section disposed between said first side walls.

19. A processing head according to claim 18, wherein said first side walls and a second side wall (164D) which connects one longitudinal end portion of one of said first side walls to that of the other define in combination a U-shaped wall.

20. A processing head according to claim 19, wherein an outlet (176) for said gas is formed along and in the vicinity of said second side wall, said outlet having the shape of a slit.

21. A processing head according to claim 20, wherein said outlet is communicated with a pump which feeds said gas.

22. A processing head according to claim 18, wherein each of said first side walls defines a part of a frame in the shape of a projection.

* * * * *